US005805041A

United States Patent [19]

Castonguay et al.

[11] Patent Number: 5,805,041

[45] Date of Patent: Sep. 8, 1998

[54] ELECTRONIC TRIP UNIT CONVERSION KIT FOR HIGH AMPERE-RATED CIRCUIT BREAKERS

[75] Inventors: Roger N. Castonguay, Terryville; Jeffrey D. Lord, Unionville, both of Conn.

[73] Assignee: General Electric Company, New York, N.Y.

[21] Appl. No.: 664,608

[22] Filed: Jun. 18, 1996

[51] Int. Cl.[6] ..... H01H 9/00

[52] U.S. Cl. ..... 335/177; 335/167; 335/172; 335/176; 335/178; 335/179; 335/21; 200/309; 200/400

[58] Field of Search ..... 335/172, 167, 335/21, 176–9; 200/309, 400

[56] References Cited

U.S. PATENT DOCUMENTS

| | | | |
|---|---|---|---|
| 3,073,936 | 1/1963 | Baird | 200/168 |
| 3,761,778 | 9/1973 | Willard | 317/33 R |
| 4,536,726 | 8/1985 | Hideo | 335/23 |
| 4,672,501 | 6/1987 | Bilac et al. | 361/96 |
| 5,122,771 | 6/1992 | Panus et al. | 335/172 |
| 5,646,586 | 7/1997 | Castonguay et al. | 335/132 |

*Primary Examiner*—Michael L. Gellner
*Assistant Examiner*—Tuyen T. Nguyen
*Attorney, Agent, or Firm*—Richard A. Menelly; Carl B. Horton

[57] ABSTRACT

A field-installable circuit breaker trip actuator unit includes a flux shifter unit that interfaces with the circuit breaker operating mechanism and is installable without dismantling the circuit breaker components. The flux shifter unit responds to an electronic trip unit to articulate the circuit breaker operating mechanism and separate the circuit breaker contacts upon occurrence of an overcurrent condition. A reset arrangement allows the trip actuator unit to be automatically reset upon completion of the contact separation process.

28 Claims, 3 Drawing Sheets

ELECTRONIC TRIP UNIT CONVERSION KIT FOR HIGH AMPERE-RATED CIRCUIT BREAKERS

BACKGROUND OF THE INVENTION

High ampere-rated circuit breakers such as described within U.S. Pat. No. 3,073,936 entitled "Electric Circuit Interrupter" are currently employed within industrial manufacturing facilities to protect the electrical equipment and buildings from damage due to overcurrent conditions within the electrical distribution system. Earlier manufactured circuit breakers employed thermal-magnetic trip units to determine overcurrent conditions and to articulate the circuit breaker operating mechanism to separate the circuit breaker contacts to interrupt the associated electric circuit. Later manufactured circuit breakers employed electronic trip units which contained so-called "flux shifters" to articulate the operating mechanism upon signal from the electronic trip unit. One example of an early electronic trip unit is found in U.S. Pat. No. 3,761,778 entitled "Static Trip Control Unit for Electric Circuit Breaker".

Such robust circuit breakers remain in operation to this date without needing 15 replacement or repair. However, state of the art digital trip units of the type described within U.S. Pat. No. 4,672,501 entitled "Circuit Interrupter and Controller Unit provide more reliable protection by better control over the circuit interruption time and current parameters. It would be economically advantageous to incorporate state of the art digital trip units within existing circuit breakers without having to dismantle the circuit breaker operating components in the process.

One purpose of the invention, accordingly, is to provide a conversion unit that will incorporate digital trip units within existing circuit breakers without having to dismantle the circuit breaker operating components.

SUMMARY OF THE INVENTION

In accordance with the invention, an electronic trip unit conversion kit includes a flux shifter and reset arrangement to articulate the circuit breaker operating mechanism upon the occurrence of an overcurrent condition to separate the circuit breaker contacts and to reset the flux shifter after the circuit breaker contacts have become separated.

DESCRIPTION OF THE PREFERRED EMBODIMENT

Figure 1:
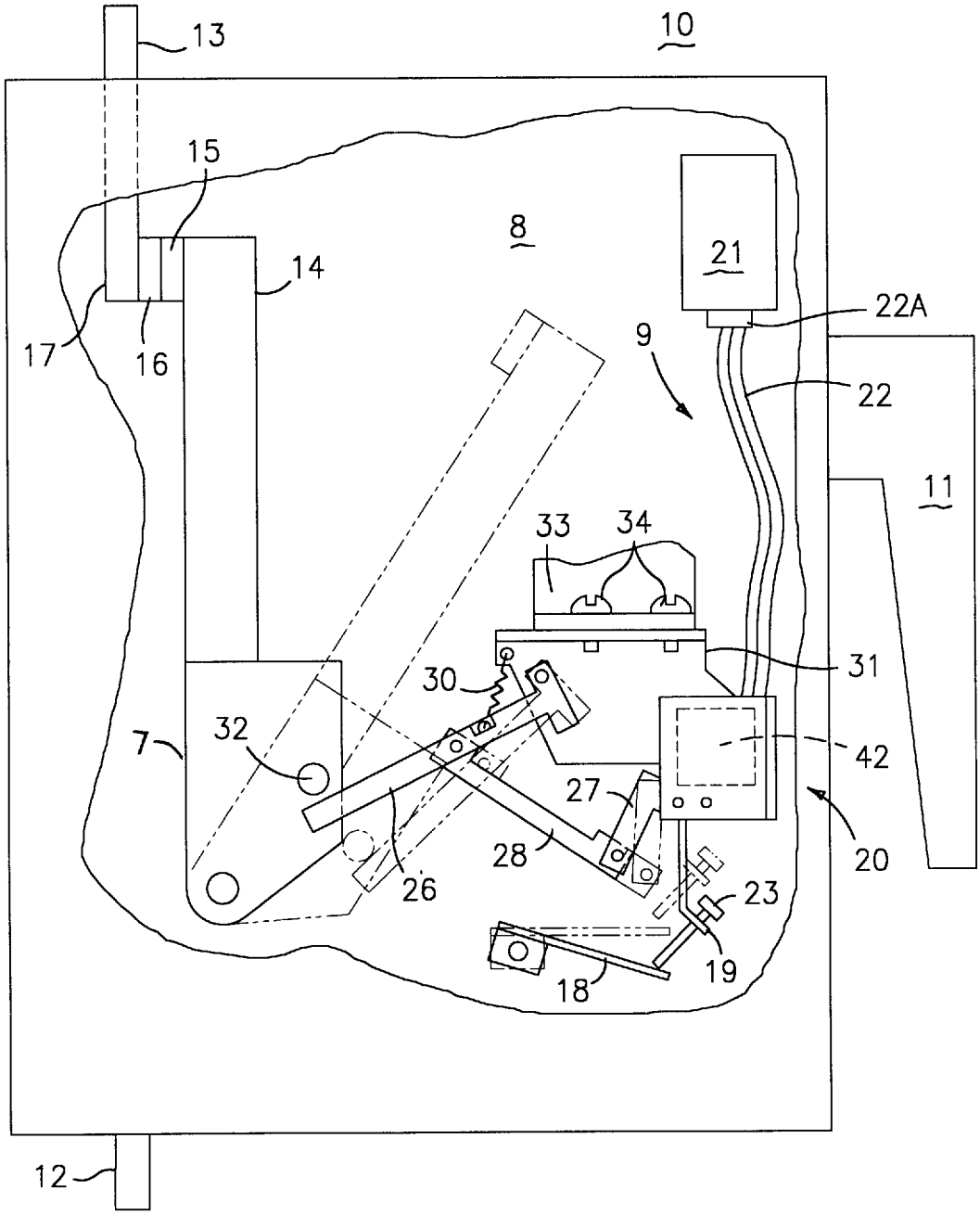
FIG. 1 is a side view of a circuit breaker with a part of the case removed to depict the circuit breaker contact arm, contacts and the electronic trip unit conversion kit in accordance with the invention.
Figure 2:
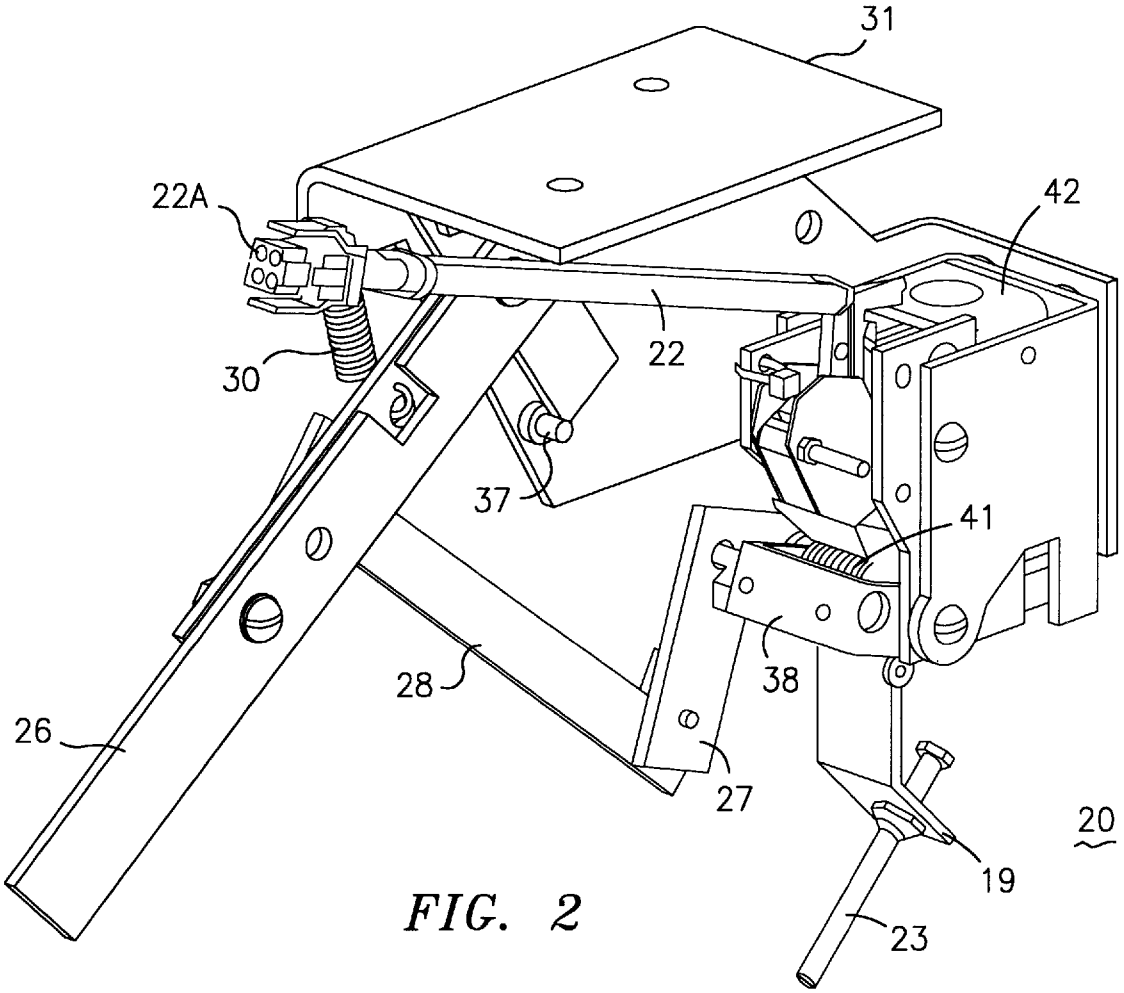
FIG. 2 is a top perspective view of the trip actuator of FIG. 1 completely assembled.
Figure 3:
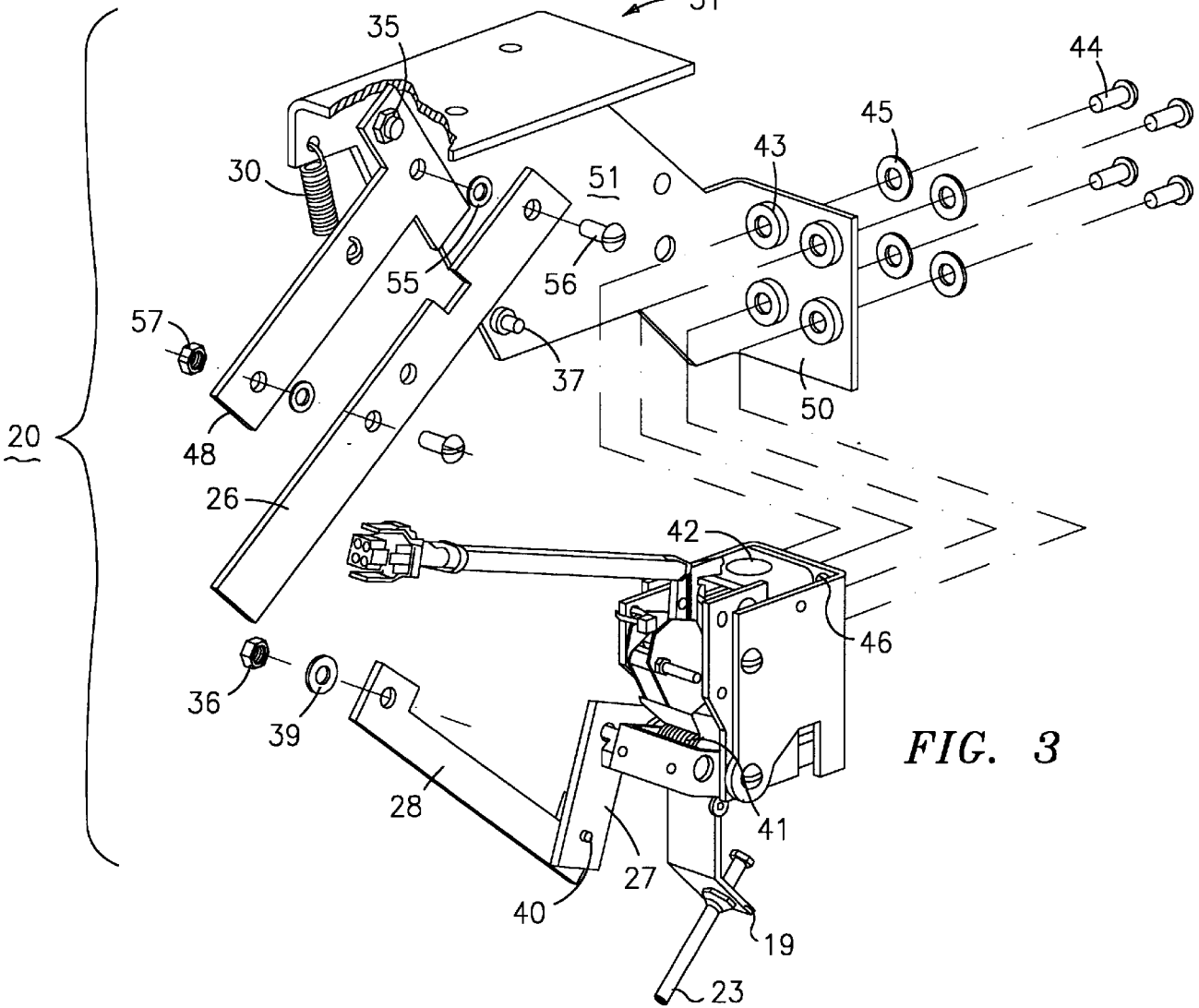
FIG. 3 is a top perspective view of the components of the trip actuator shown in FIG. 2.

The trip unit conversion kit 9 in accordance with the invention, is best seen by referring jointly to FIGS. 1–3. An industrial-rated circuit breaker 10, such as described in aforementioned U.S. Pat. No. 3,073,936, with an operating handle 11 extending from the top with load straps 12 and line straps 13 arranged at opposite ends thereof. The movable contacts 15 at one end of the movable contact arm 14 and the fixed contacts 16 on the contact support 17 are shown in solid lines in the CLOSED condition and in phantom lines in the OPEN condition. The condition of the contacts are controlled by an operating mechanism (not shown) that is refrained from articulation by means of a trip latch 18 in the manner described within the aforementioned U.S. Pat. No. 3,073,936. The electronic trip unit adapter 9 includes an electronic trip unit 21 such as described within the aforementioned U.S. Pat. No. 4,672,501 which is mounted within the circuit breaker interior 8 and connects with the trip actuator unit 20 by means of the electric cable 22 and wire connectors 22A. The trip actuator unit is separately mounted within the circuit breaker interior by means of a support or mounting bracket 31 which is attached to a circuit breaker support plate 33 by means of screws 34, as indicated. The reset lever 26 extends from the pivot plate 48 and abuts at one end against the contact arm carrier post 32 which extends from the movable contact arm 14 and is biased against the contact arm post 32 by means of a return spring 30. The movable contact arm 14 is connected with the crossbar 7. The other end of the reset lever is pivotally attached to the mounting bracket in the manner to be described below. Upon receipt of a trip signal from the trip unit 21, the flux shifter unit 42 within the trip actuator unit 20 releases the flux shifter trip plunger 19 such that the trip adjusting screw 23 threaded into trip plunger 19 strikes the circuit breaker trip latch 18 rotating the trip latch to the position shown in phantom and allowing the circuit breaker operating mechanism to separate the contacts 15, 16 as described in the aforementioned U.S. Pat. No. 3,073,396. The reset lever 26 is attached to a reset arm 27 within the trip actuator unit 20 by means of a connector link 28 to return the trip plunger 19 from the actuated position depicted in solid lines to the reset position shown in phantom. The reset lever 26 is then returned to the solid position under the urgence of the return spring 30. The reset lever interacts with the contact arm carrier post 32 to reset the trip actuator unit 20 as shown in phantom in a manner described in U.S. patent application Ser. No. 08/551,640 entitled "Electronic Trip Unit Conversion Kit for High Ampere-Rated Circuit Breakers". The trip unit conversion kit 9 is attached to the circuit breaker interior by securing the mounting bracket 31 to the circuit breaker interior plate 33 by means of screws 34.

As shown in FIG. 2 & 3, the reset lever 26 within the trip actuator unit 20 is pivotally attached to the mounting bracket 31 by a threaded stud 35 and nut 36. The return spring 30 connects between the reset lever 26 and the top of the side wall 51 of the mounting bracket 31 and is positioned to bias the reset lever 26 against the stop pin 37 which is riveted to the bottom of the side wall 51. The connector link 28 is fixedly attached at one end to the reset lever 26 by means of the threaded stud 35, nut 36 and washer 39. The other end of the connector link 28 is pivotally attached to one end of the reset arm 27 as indicated at 40. The other end of the reset arm is attached to the flux shifter reset bracket 38 on the flux shifter unit 42 contained within the trip actuator unit 20. The position of the flux shifter reset bracket 38 is determined by the reset spring 41 in the manner described in the aforementioned U.S. patent application Ser. No. 08/551,640. Upon displacement of the reset lever 26 by the circuit breaker contact arm carrier post 32 in FIG. 1, the reset arm 27 rotates the flux shifter reset bracket 38 against the return bias of the reset spring 41 to return the flux shifter trip plunger 19 to the home position as shown in phantom lines. As shown in FIG. 3, the trip actuator unit 20 is attached to the front wall 50 of the mounting bracket 31 by means of the rubber grommets 43, screws 44, insulative washers 45 and threaded apertures 46. The use of rubber grommets substantially reduces the vibration generated within the circuit breaker interior from affecting the operation of the flux shifter unit 42 within the trip actuator unit 20 and is an important feature of the invention as a means of preventing so-called "nuisance tripping" by inadvertent release of the flux shifter plunger 19 by such excessive vibration. Another important feature of the invention is the use of an insulative material for the reset lever 26 or an insulative coating when such reset lever is made of steel in order to prevent the transfer of current from the circuit breaker contact arm to the trip actuator unit. When both the reset lever 26 and the pivot plate 48 are made of steel, electrically-insulative washers 55 are interposed between the metal screws 56 and nuts 57 to insure good electrical isolation between the reset lever and the support plate.

We claim:

1. A circuit breaker electronic trip unit conversion kit comprising:

a support bracket;

a reset lever pivotally arranged on said support bracket and adapted for interacting with a circuit breaker cross bar;

a trip actuator unit attached to said support bracket, said trip actuator unit including a flux shifter unit and a flux shifter plunger, said plunger adapted for articulating a circuit breaker operating mechanism to separate circuit breaker contacts upon command;

a flux shifter reset bracket on said flux shifter unit for returning said flux shifter plunger to a home position upon re-closure of circuit breaker contacts; and a connector link interacting between said reset lever and said flux shifter bracket for moving said flux shifter plunger to said home position in response to movement of said reset lever; and a reset arm pivotally connecting with a first end of said connector link and fixedly connecting with said flux shifter bracket.

2. The circuit breaker electronic trip unit conversion kit of claim 1 wherein a first end of said reset lever is attached to said support bracket by means of a cruciform pivot plate.

3. The circuit breaker electronic trip unit conversion kit of claim 2 wherein a second end of said reset lever is pivotally attached to a second end of said connector link.

4. The circuit breaker electronic trip unit conversion kit of claim 2 wherein said pivot plate includes a pair of first and second arms at one end joined at one end of an extending leg, said first of said pivot plate arms being pivotally attached to said support bracket, and said second of said pivot plate arms being positioned in abutment with a stop pin on said support bracket.

5. The circuit breaker electronic trip unit conversion kit of claim 4 wherein an opposite end of said extending leg is attached to said reset lever.

6. The circuit breaker electronic trip unit conversion kit of claim 4 further including a return spring connecting between said extending leg and said support bracket, said return spring arranged for holding said second arm in abutment against said stop pin.

7. The circuit breaker electronic trip unit conversion kit of claim 3 wherein said first end of said connector link attaches to said reset lever intermediate said first and second reset lever ends.

8. The circuit breaker electronic trip unit conversion kit of claim 2 wherein said flux shifter plunger articulates a circuit breaker operating mechanism via a trip actuator screw.

9. The circuit breaker electronic trip unit conversion kit of claim 1 wherein said support bracket comprises a metal plate shaped to define a front wall extending in a first plane, said front wall being adapted for attachment with said trip actuator unit.

10. The circuit breaker electronic trip unit conversion kit of claim 9 wherein said support bracket further defines a side wall extending from said front wall in a second plane perpendicular to said first plane, said side wall being adapted for attachment with said first arm of said pivot plate.

11. The circuit breaker electronic trip unit conversion kit of claim 10 wherein said support bracket additionally defines a top wall extending from said front wall in said first plane, said top wall being adapted for connection with a circuit breaker interior.

12. The circuit breaker electronic trip unit conversion kit of claim 9 wherein said trip actuator unit is attached to said front wall via resilient grommets.

13. The circuit breaker electronic trip unit conversion kit of claim 2 wherein said reset lever is electrically insulated from said support bracket.

14. The circuit breaker electronic trip unit conversion kit of claim 2 wherein said reset lever is attached to said support bracket by means of electrically-insulative grommets.

15. A circuit breaker adapted for responding to an over-current electronic trip signal comprising:

an enclosure;

a pair of contacts within said enclosure for interrupting circuit current on command;

a line strap on one end of said enclosure for connecting said contacts with an electrical source;

a line strap on an opposite end of said enclosure for connecting said contacts with electrical equipment;

an operating handle extending from said enclosure for manual control of said contacts;

electronic means for providing a trip initiating signal;

a support bracket;

a reset lever pivotally arranged on said support bracket and adapted for interacting with a circuit breaker cross bar;

a trip actuator unit attached to said support bracket, said trip actuator unit including a flux shifter unit and a flux shifter plunger, said plunger adapted for articulating a circuit breaker operating mechanism to separate circuit breaker contacts upon command;

a flux shifter reset bracket on said flux shifter unit for returning said flux shifter plunger to a home position upon re-closure of circuit breaker contacts;

a reset arm pivotally arranged on said trip actuator unit and connecting with said flux shifter bracket a connector link attached to said reset arm at one end and arranged for interacting with said circuit breaker cross bar at an opposite end, whereby said cross bar motivates said connector link and said reset arm upon separation of said circuit breaker contacts.

16. The circuit breaker of claim 15 wherein a first end of said reset lever is attached to said support bracket by means of a cruciform pivot plate.

17. The circuit breaker of claim 15 wherein a second end of said reset lever is pivotally attached to a second end of said connector link.

18. The circuit breaker of claim 16 wherein said pivot plate includes a pair of first and second arms at one end joined at one end of an extending leg, said first of said pivot plate arms being pivotally attached to said support bracket, and said second of said pivot plate arms being positioned in abutment with a stop pin on said support bracket.

19. The circuit breaker of claim 18 wherein an opposite end of said extending leg is attached to said reset lever.

20. The circuit breaker of claim 18 further including a return spring connecting between said extending leg and said support bracket, said return spring arranged for holding said second arm in abutment against said stop pin.

21. The circuit breaker electronic trip unit conversion kit of claim 17 wherein said first end of said connector link attaches to said reset lever intermediate said first end and said second end of said reset lever.

22. The circuit breaker of claim 15 wherein said flux shifter plunger articulates said circuit breaker operating mechanism via a trip actuator screw.

23. The circuit breaker of claim 15 wherein said support bracket comprises a metal plate shaped to define a front wall extending in a first plane, said front wall being adapted for attachment with said trip actuator unit.

24. The circuit breaker of claim 18 wherein said support bracket further defines a side wall extending from said first wall in a second plane perpendicular to said first plane, said side wall being adapted for attachment with said first arm of said pivot plate.

25. The circuit breaker of claim 23 wherein said support bracket additionally defines a top wall extending from said first wall in said first plane, said top wall being adapted for connection with a circuit breaker interior.

26. The circuit breaker of claim 23 wherein said trip actuator unit is attached to said front wall via resilient grommets.

27. The circuit breaker of claim 15 wherein said reset lever is electrically insulated from said support bracket.

28. The circuit breaker of claim 15 wherein said reset lever is attached to said support bracket by means of electrically-insulative grommets.

* * * * *